US006883955B2

(12) United States Patent
Salas et al.

(10) Patent No.: US 6,883,955 B2
(45) Date of Patent: Apr. 26, 2005

(54) VIBRATIONAL PAINT SHAKER WITH MANAGED CAN DETECTION AND CLAMPING FEATURES

(75) Inventors: Martin Miguel Salas, Lake Wylie, SC (US); Peter Markus Tenz, Marvin, NC (US)

(73) Assignee: Ultrablend Color, LLC, Charlotte, NC (US)

( * ) Notice: Subject to any disclaimer, the term of this patent is extended or adjusted under 35 U.S.C. 154(b) by 173 days.

(21) Appl. No.: 10/200,826

(22) Filed: Jul. 22, 2002

(65) Prior Publication Data

US 2004/0013031 A1 Jan. 22, 2004

(51) Int. Cl.[7] ..... B01F 11/00

(52) U.S. Cl. ..... 366/110; 366/209; 366/601; 366/605

(58) Field of Search ..... 366/110, 111, 366/128, 209, 601, 605

(56) References Cited

U.S. PATENT DOCUMENTS

| | | | |
|---|---|---|---|
| 2,821,172 | A | 1/1958 | Randall |
| 4,134,689 | A | 1/1979 | Ahrenskou-Sorensen |
| 4,842,415 | A | 6/1989 | Cane et al. |
| 5,066,136 | A | 11/1991 | Johnson |
| 5,184,893 | A | 2/1993 | Steele et al. |
| 5,268,620 | A | 12/1993 | Hellenberg |
| 5,310,257 | A | 5/1994 | Altieri, Jr. et al. |
| 5,462,353 | A | 10/1995 | Gatlin |
| 5,662,416 | A | 9/1997 | Dwigans, II |
| 5,749,652 | A | 5/1998 | Brunn et al. |
| 5,904,421 | A | 5/1999 | Mazzalveri |
| 5,906,433 | A | 5/1999 | Mazzalveri |

FOREIGN PATENT DOCUMENTS

| | | | |
|---|---|---|---|
| GB | 1 310 655 | * | 3/1973 |

* cited by examiner

*Primary Examiner*—David L. Sorkin
(74) *Attorney, Agent, or Firm*—Kennedy Covington Lobdell & Hickman, LLP

(57) ABSTRACT

An improved method of detecting the height of, and clamping, a paint or other liquid-containing can relies upon a subtractive comparison of a current draw of a clamping motor to a baseline reference current draw in order to detect the can height. Because the baseline reference current draw accounts for anomalous current draw readings, periodic manual adjustment of the current draw level considered to indicate a can height is unnecessary. The method further includes advanced detection and elimination of gaps developing between the can and the clamping apparatus. A system for agitating a liquid-containing can includes apparatus to carry out can-height detection, clamping, and gap detection and correction using current draw, can height, and clamping plate position data.

19 Claims, 6 Drawing Sheets

VIBRATIONAL PAINT SHAKER WITH MANAGED CAN DETECTION AND CLAMPING FEATURES

FIELD OF THE INVENTION

The present invention relates generally to the field of agitating paint cans for the purposes of blending paint located therein, and more particularly for an apparatus for and method of shaking paint cans with managed can detection and clamping features.

BACKGROUND OF THE INVENTION

In order to sell a variety of custom paint colors, paint vendors typically employ a system of mixing paint in custom colors whereby cans of base paint are tinted with various quantities of differently colored pigments in predetermined ratios, according to a process that is well known to those skilled in the art to which this invention relates. Because this tinting occurs in the retail store as the final step before the paint is delivered to the purchaser, it is necessary, for purposes of ensuring that the paint has been properly tinted and that the pigment is thoroughly mixed into the base paint, to blend the paint by one of a variety of methods.

Among the more popular of methods for blending the paint is by agitating the closed container, just after tinting, for some amount of time sufficient to ensure proper blending. While it is possible to blend the paint by manually shaking the container, it is more efficient, quicker, and less tiring to employ a mechanical paint can agitator, which works by moving the container through an iterative series of motions. These mechanical agitators typically fall into one of four varieties: the vibrational, or "case shaker," variety; the gyroscopic, or "end-over-end" variety; the reciprocal motion variety; and the semi-gyroscopic or "orbital" variety. In the vibrational and gyroscopic agitators, holding the can securely is of particular importance. In the gyroscopic method, the motion of the paint can is typically end-over-end, such that the paint contained therein is blended by virtue of vortices that develop as the paint is acted upon by gravity and the motion of the gyroscope. In the vibrational method, the paint can is rapidly driven in an up-and-down motion, and the paint is blended by vortices that develop primarily because of the inertia of the paint as the can is drawn through the range of motion. The vibrational method typically employs, for mechanical and fluid-mechanical reasons, an elliptical path for the paint can, though which the orientation of the paint can is maintained.

In vibrational and gyroscopic mixers, it is essential that the paint can be firmly gripped, because the can is usually moved through as many as 700 revolutions per minute. The unintended consequences of an undergripped paint can generally include the spillage of paint inside the agitator, which is at best untidy and at worst damaging to the machine (as well as wasteful of paint), and physical damage to the machine or injury to those in proximity, if the can is "thrown" with sufficient force.

In order to grip a can in a vibrational paint shaker, conventional designs have typically utilized a pair of clamping plates. A paint can is placed on the bottom plate, and the top plate is driven downward into engagement with the can; as specified amount of force is applied thereon, and the can is consequently clamped for agitation. Various means for driving the top plate downward have been proposed, and a typical apparatus utilizes a plate mounted, by threaded nuts, on two or more set screws. A motor drives the screws so as to drive the plate up or down, into or out of engagement with the can.

Conventional designs further control the motion of the drive plate by applying an electrical current at a specified, controlled voltage to the motor, and by monitoring the current draw of the motor and the positioning of the screws, can determine by inference if a can has been clamped. Specifically, in conventional systems it has been determined that at a particular level of current draw (which is indicative of the mechanical resistance encountered by the motor in driving the plan downward), it is likely that a can has been encountered, and the plate should be driven to a predetermined amount of pressure (sufficient to hold the can in place during agitation) and held in place.

In such a system, a number of attendant problems are presented. For instance, because of changes in the profile of the screws or the threaded nuts over a period of use, or because of the presence of dried paint, corrosion, dirt, or other foreign matter within the threads, it is possible for a current draw in excess of the predetermined level for indicating the presence of a can to be detected, even if no can is present. If such an operating condition is not detected before agitation begins, serious damage to the machine and waste of paint will almost certainly occur.

Further, because of the rapid nature of the agitation and because of the inertia of the paint can and the paint within the can, it is possible for a gap to develop between either of the clamping plates and the paint can, which can cause unwanted noise, damage to the can or to the machine, and waste of paint. Conventional systems attempt to address this problem by continuing to apply pressure to the can during agitation (which can lead to crushing of the can) or by stopping the agitation cycle (which is inefficient), if a gap develops.

Moreover, because the motors used in conventional systems are typically large and must overcome a great deal of inertia in order to begin agitating the can, a dedicated, specially wired power source is usually employed, which leads to added expense to the store in which a conventional system is used.

Consequently, what is needed is a clamping system that is "smart" in operation—i.e., a system in which the processes associated with sensing the presence of cans are managed more carefully than in conventional systems, such that the system can differentiate between the presence of a paint can and wear or the presence of foreign matter on the threads, and such that it can differentiate between different can sizes and apply clamping pressure accordingly. Also, because different levels of clamping pressure are required in order to hold the load securely, depending upon the size and number of cans present, it is desirable to have a clamping system that can identify the amount of clamping pressure needed to hold the load securely. A further need is felt for a paint can agitator that can be used with a standard, non-dedicated power source.

SUMMARY OF THE PRESENT INVENTION

It is accordingly an object of the present invention to meet the above identified needs, and other needs, by providing a system in which a paint can or paint cans are securely held during agitation irrespective of the height of the paint can, the tendency of the clamping plates to move during agitation, or the presence of worn or contaminated screw threads within the clamping system.

It is another object of the present invention to provide a method of shaking a paint can wherein the chances of damage to the paint can or to the shaker mechanism, which damage may arise from a variety of sources, are minimized or eliminated.

It is a further object of the present invention to provide a system for agitating paint cans that is substantially free of the need, on the part of the operator, to engage in a significant amount of training or activity in operating the system, and in that system to automate as many of the essential processes as can be automated.

It is yet another object of the present invention to provide a system which is capable of clamping and shaking a variety of paint cans of varying compositions and sizes, in order to provide the maximum usefulness to the establishment employing the system.

It is still a further object of the present invention to provide a system for agitating paint cans that is capable of being powered using a standard, non-dedicated power source by reducing the impact of motor inertia on the operation of the system.

These and other objects are met in various aspects of the present invention, which is for a mechanical paint can agitator of the vibrational variety. The present invention generally includes an outer frame, preferably covered on three sides and its top with panels, and an inner frame mounted within the outer frame and mechanically isolated therefrom by springs. The inner frame is capable of being driven through a range of motion associated with agitation by a drive motor. The inner frame is provided with a can support location such as a bottom clamping plate or clamping tray; a clamping plate, such as a top clamping plate; and some structure for supporting and driving the clamping plate, such as two or more screws mounted vertically on the inner frame, a single screw and at least one slide, a linear actuator, or the like.

The inner frame is further provided with a clamping motor operable under microprocessor control to drive the screws in order to change the position of the clamping plate. An encoder is arranged to detect the position of the clamping plate in one of a number of possible ways, such as by counting the revolutions of the clamping motor of the revolutions of the screws, or by directly reading the position of the clamping plate. Connected to the clamping motor is means for detecting a current draw of the clamping motor, such as an analog input, which provides an input to the microprocessor signaling the magnitude of that current draw. The present invention may be further equipped with a drive motor control for controlling the drive motor, which drive motor control is operable under the control of the microprocessor or of a separate microprocessor according to a detected characteristic, such as the height, of the can to be shaken.

Another feature of the present invention is a method of clamping at least one liquid-containing can in a mechanical agitator substantially as described above, wherein the method generally includes the steps of establishing a baseline reference current draw for the clamping motor when driving the clamping plate through a reference distance, detecting an actual current draw for the electrical motor when driving the clamping plate through a driver distance, subtracting the baseline reference current draw from the actual current draw to produce a current draw margin, and detecting a can height for the can based upon the value of the current draw margin.

Still another feature of the present invention is a method of retaining a clamped liquid-containing can, such as a paint can, within a mechanical agitator as above, which includes the steps of detecting a reference position of the upper clamping plate by measuring the number of rotations of at least one of the screws, monitoring the screws for any detected rotation during agitation (because any such rotation would indicate a release of at least a portion of the initial clamping pressure), and increasing the clamping pressure on the paint can to a level incrementally higher than the initial clamping pressure. Additional steps of the method of the present invention include determining a maximum acceptable clamping pressure for the can, and, as a safety feature (to prevent damage to the machine), discontinuing agitation if the apparent increased clamping pressure would exceed that maximum acceptable clamping pressure. The initial clamping pressure may be detected based upon a detected can height. In a further feature of a the present invention, the drive motor is brought gradually from a state of rest to a desired rate of agitation. In still a further feature of the present invention, the weight and number of cans loaded in the agitator are inferred based upon the amount of current draw required by the drive motor to bring the inner frame from the bottom to the top of its range of motion, and the initial clamping pressure is adjusted, or agitation discontinued, according to the weight and number of cans loaded.

BRIEF DESCRIPTION OF THE DRAWINGS

Further features, embodiments, and advantages of the present invention will become apparent from the following detailed description with reference to the drawings, wherein.

DETAILED DESCRIPTION OF THE PREFERRED EMBODIMENTS

Figure 1:
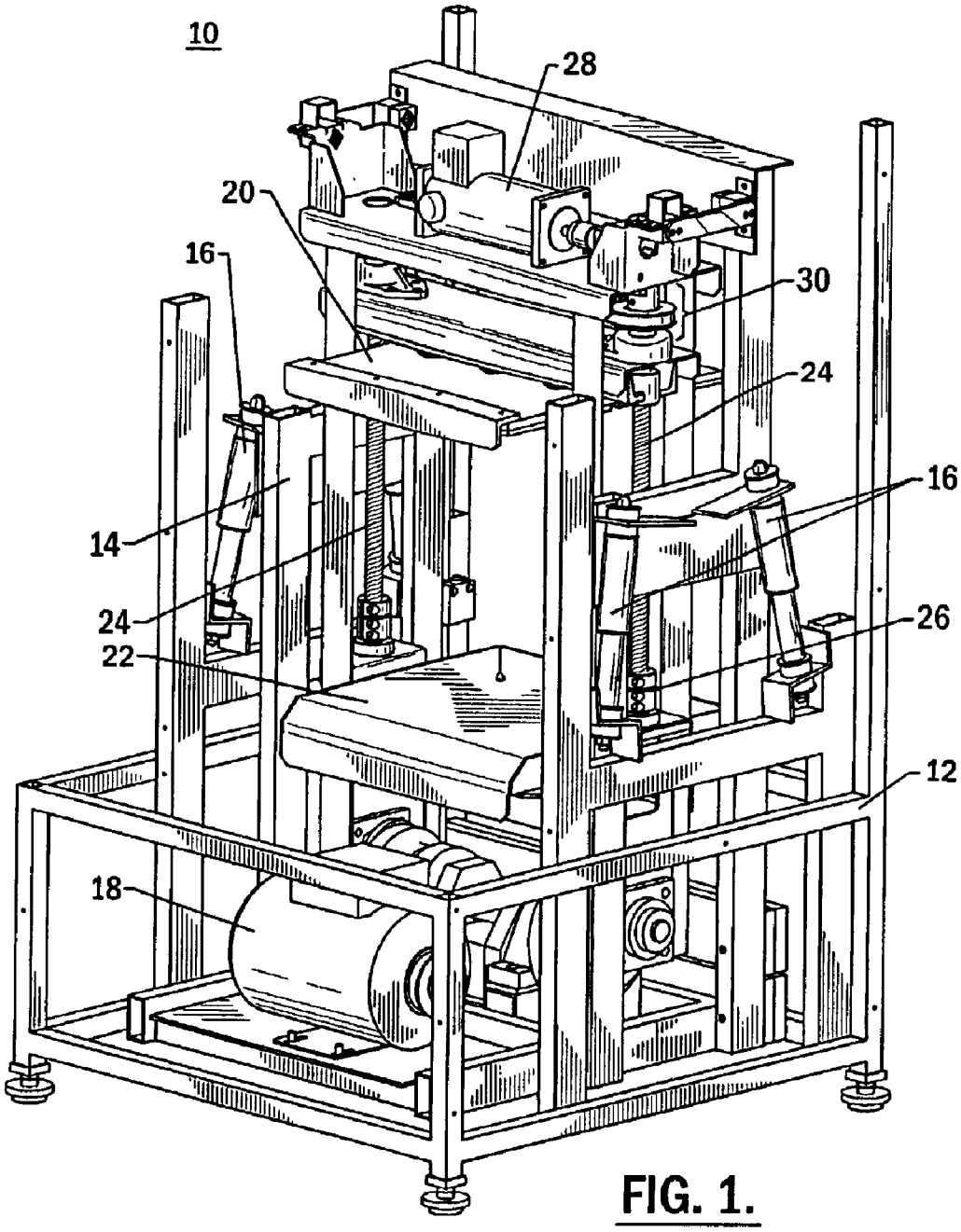
FIG. 1 is a general perspective view depicting a mechanical paint agitator according to the present invention.

Referring now to FIG. 1, the present invention is depicted in a generalized perspective view. The present invention is embodied as a mechanical can agitator 10 that includes an outer frame 12 and an inner frame 14 mounted within but mechanically isolated from the outer frame 12 by means of mechanical isolators 16 (such as springs, shock absorbers, struts, or the like), such that the inner frame 14 is free to move within the outer frame 12 in a predetermined range of motion. The motion of the inner frame 14 is driven by a drive motor 18, which is mounted to the outer frame 12 and drives the inner frame 14 through any one of a number of mechanisms well known to those skilled in the art, and it will be recognized by such persons that it is the fact of controllably driving the inner frame 12, and not the particular mechanism for accomplishing the driving, that is important to the present invention. In order to control the action of the drive motor 18, the drive motor 18 is advantageously provided with drive motor control 19 (see FIG. 2), which may be controlled by an independent microprocessor 34B (see FIG. 2) or by a shared microprocessor 34 (not shown).

The inner frame 14 is provided with a top clamping plate 20 and a can support surface 22, which may be a bottom clamping plate or a clamping tray, along with means 24 for supporting and driving the top clamping plate 20, such as two or more screws 24. Although in the preferred embodiment two screws 24 are used, it is possible to utilize multiple screws 24, or to utilize a single screw 24 and one or more slider rods, or to support to clamping plate 20 using a linear actuator with an extensible piston, without departing from the scope of the present invention. For ease of explanation, the discussion below will refer to the screws 24, but those skilled in the art will recognize that the above-identified alternative means for supporting and driving the top clamping plate 20 will be usable instead. The top clamping plate 20 is provided with a threaded aperture 40 (see FIG. 2) for each of the screws 24, complementary to the threads of those screws 24, and the top clamping plate 20 is mounted to the screws 24 such that the screws are threaded through the apertures 40 in the top clamping plate 20. If the system is provided with a different means for supporting and driving the clamping plate 20, those skilled in the art will recognize that the clamping plate will be modified to adapt to the means for supporting and driving. The screws 24 are mounted to the inner frame 14 on bearings 26, so that the screws 24 are free to rotate axially. As the screws 24 are rotated synchronously, the top clamping plate 20 is driven up or down, depending upon the angular direction of rotation of the screws 24.

Figure 2:
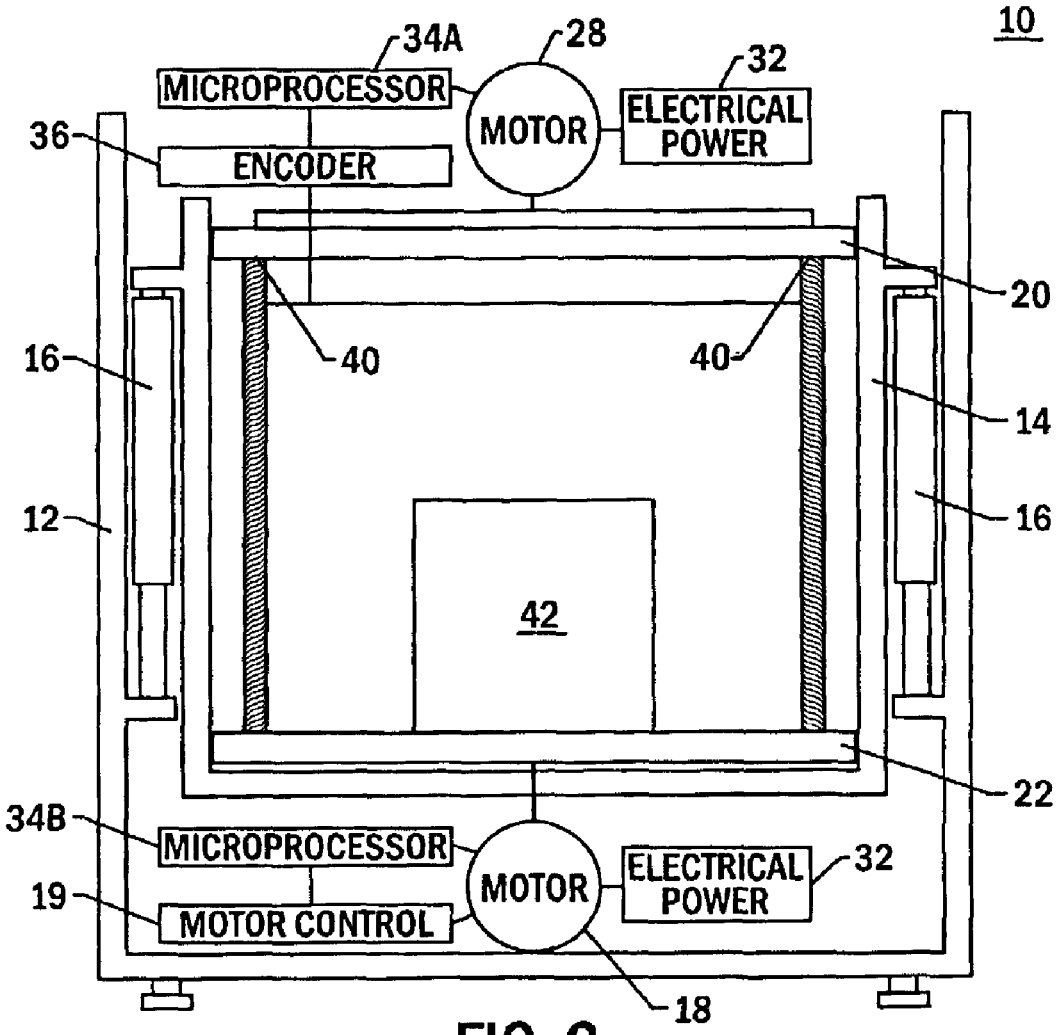
FIG. 2 is a simplified schematic view of a mechanical paint agitator according to the present invention.

Referring to FIGS. 1 and 2, the screws 24 themselves are driven by a clamping motor 28 mounted to the inner frame 14 and connected by some form of mechanical linkage 30, such as a gearing system, a drive belt, or other means, or a combination thereof, to the screws 24. The clamping motor 28 is preferably powered by a direct-current electrical supply 32, for a purpose that will become clear below. As the clamping motor 28 is driven with a given polarity of the electrical current applied thereto, the screws 24 are turned in a given direction and the top clamping plate 20 is driven down. If the polarity of the current is reversed, the screws 24 are turned in the opposite direction and the top clamping plate 20 is driven up. Those skilled in the art to which the present invention relates will recognize that the polarity of the electrical current must be chosen depending upon the threading direction of the screws 24 and characteristics of the mechanical linkage 30.

The clamping motor 28 is preferably outfitted with a microprocessor control 34A. One or more of the screws 24 is provided with an encoder 36, which is utilized to detect the height of the clamping plate, and the encoder 36 is wired to provide a signal indicating same to the microprocessor 34A. Those skilled in the art will recognize that the encoder 36 may be positioned at various points between the clamping motor 28 and the clamping plate 20. For instance, in a preferred embodiment, the encoder 36 is positioned about the clamping motor 28 before any gear reduction, so as to provide a higher degree of resolution of measurement. However, the encoder 36 could as easily be arranged to measure the turning of the screws 24, or the linear position of the clamping plate 20, without departing from the scope of the invention, and various programming adjustments in the microprocessor programming will be necessary to calculate the position of the clamping plate 20 based upon the data provided by the encoder 36. The microprocessor 34A is also programmed and wired with an analog input as part of its connection to the clamping motor 28 in order to detect the current draw of the clamping motor 28 when it is in an energized state.

Figure 3A:
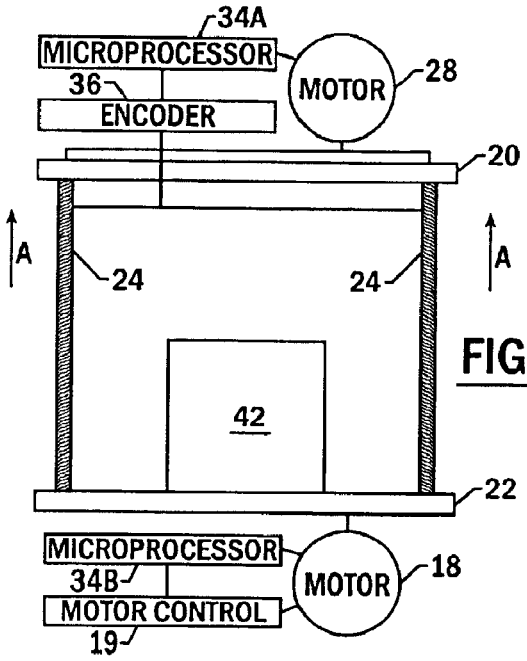
FIGS. 3A–3C are a series of schematic views of a clamping mechanism according to the present invention.
Figure 3B:
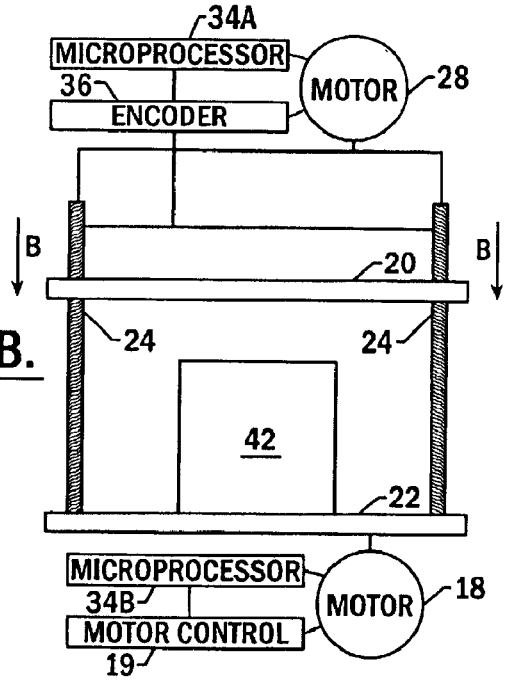
Figure 3C:
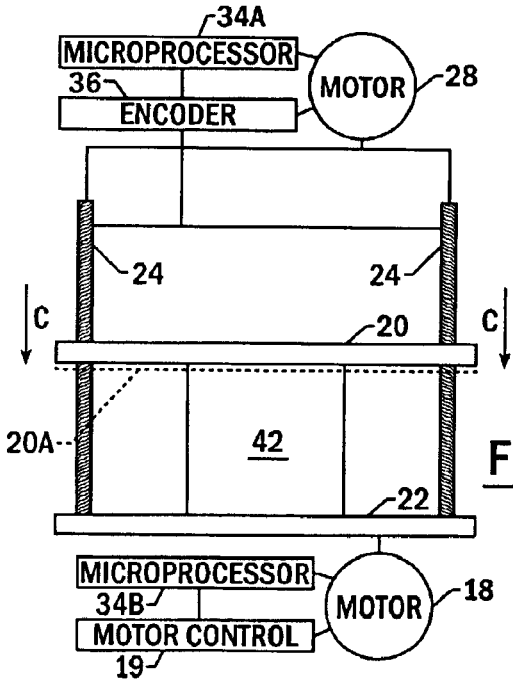

Referring additionally to FIGS. 3A–3C, a can of paint 42 is placed on the support surface 22, and the clamping sequence is activated. In order to ensure that the position of the top clamping plate 20 is measured accurately and that the full range of available can heights is maximized, it is helpful to drive the top clamping plate 20 to the uppermost limit of its range of motion (in the direction of arrow A). Assuming all safety protocols have been satisfied (which protocols will be discussed below), the microprocessor directs the motor to be energized to drive the plate in the direction of arrow B (see FIG. 3B). As the clamping plate 20 is driven downward, the clamping motor 28 will draw a particular, and potentially moderately varying, level of current that is dependent upon a number of factors, including the mechanical resistance of the motor itself and the frictional resistance of the screws 24 against the clamping plate 20. Because a specified voltage is utilized, the current draw roughly indicates the amount of energy required to drive the clamping plate 20 through a particular unit of distance associated with a turn, or fractional turn, of the screws 24, or, equivalently, the amount of energy required to be applied to the clamping plate 20 in order to generate a given amount of clamping pressure. For the purposes of the present invention, the "baseline reference" current draw is that current draw utilized in driving the top clamping plate 20 through a distance in which no can is encountered.

By monitoring the level of current draw, it is possible to detect a condition consistent with the clamping plate 20 having engaged with the top of the paint can 42, because when the paint can 42 impedes the progress of the clamping plate 20, the amount of current draw increases as the clamping motor 28 attempts to drive the clamping plate 20 further down (in the direction of arrow C). As is most easily seen in FIG. 3C, the motion of the clamping plate 20 is necessarily interrupted by the presence of a paint can 42 at a given level, and the power generated by the clamping motor 28 simply holds the can 42 in place more tightly (i.e., with greater pressure). In FIG. 3C, the phantom lines 20A indicate in an exaggerated manner the position of the clamping plate 28 after clamping pressure is applied, which causes a slight deformation of the paint can 42 while under pressure. This "clamping" stage will be discussed in greater detail below.

Conventional clamping systems in this field utilize a defined level of current draw to indicate that the can has been engaged; when the current draw reaches the predetermined level, a predetermined pressure is applied and shaking begins. While this level is necessarily higher than the baseline reference current draw, it is possible for variations in the amount of friction between the screws 24 and the clamping plate 20 to occur (because of the presence of dried paint or other foreign matter in the screw threads, or because of wear on the screws), and, over time, the amount of current draw necessary to indicate can engagement increases. This necessitates periodic adjustment of the predetermined level of current draw, and it can result in a false determination that a can is present if a localized bit of wear or foreign matter sufficiently impedes the progress of the clamping plate 20. The disastrous result (if this determination is not found to be false) is that the clamping plate 20 may not be seated on the can 42, and the can 42 may be thrown about within the machine 10 once agitation begins.

Figure 4A:
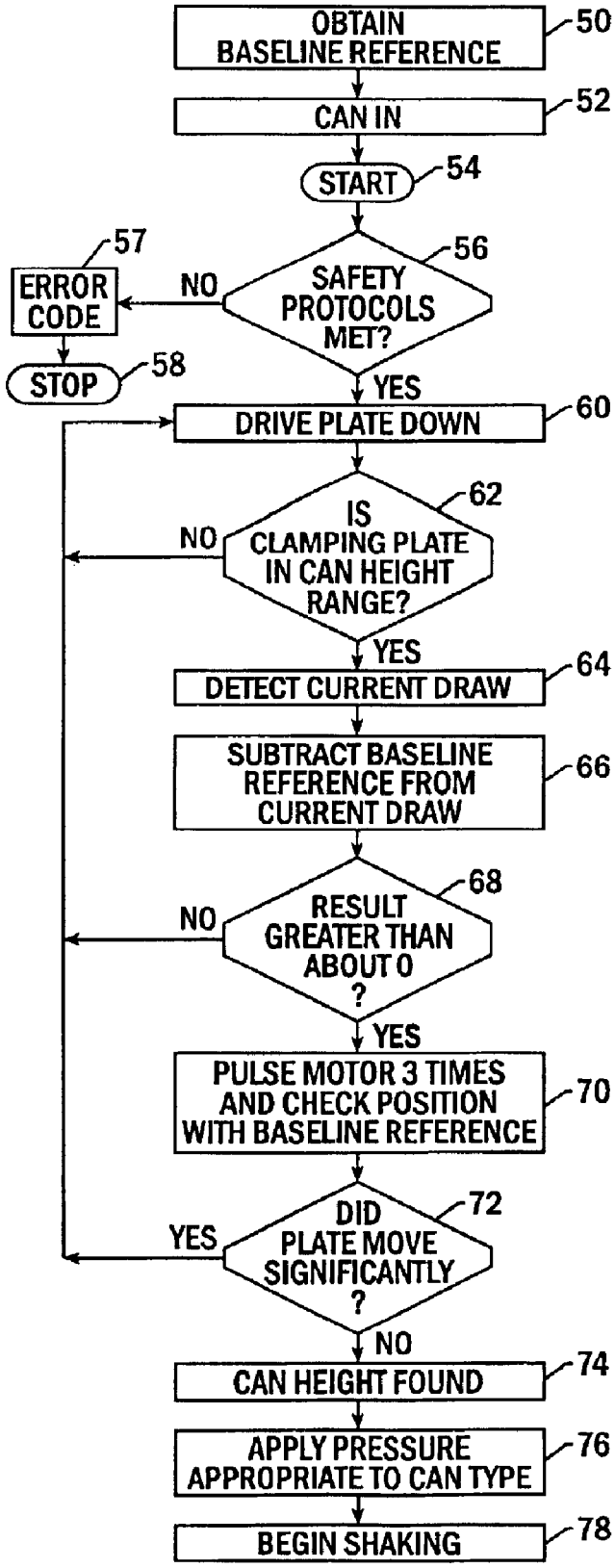
FIG. 4A is a flow chart illustrating the steps of a first preferred embodiment of a method of clamping a paint can according to the present invention.

Referring now to FIG. 4A, in the present invention, this problem is mitigated by utilizing a "subtractive" method of can-height detection. Specifically, a baseline reference current draw is determined (in FIG. 4A, at step 50) by one of two methods to be discussed in greater detail below. As the clamping plate 28 is driven through a driven distance during the clamping procedure (step 60), the actual current draw is monitored (step 62), and the baseline reference is subtracted therefrom (64). If the resulting difference, known as the current draw margin, is near zero, then the system infers that no can has been encountered and returns to step 60. If the resulting difference is substantially greater than zero, then the system infers that a can has been engaged and proceeds to step 68. For the purposes of the present invention, this process (at step 66) is referred to as "subtractive comparison" of the current draws, because the net effect of the subtraction is to determine whether the compared current draws are equal, with a disparity being consistent with the presence of a can 42 and the lack of same indicating the absence of a can 42 at the given height. In such a system, a substantial advantage is gained over conventional systems, because the likelihood of false indications of the presence of a can 42 is reduced, and because the present system needs no periodic manual adjustment in order to function.

The nature of the baseline reference current draw depends largely on the manner in which it is determined. In a first preferred embodiment of the present invention, a baseline reference for each vertical position of the top clamping plate 20 from the top of the screws 24 to the bottom is established beforehand (at step 50, FIG. 4A) by driving the top clamping plate 28 through its entire range of motion when the machine 10 is empty of paint cans 42. The current draw required to drive the clamping plate 20 through each discrete section of its range (as measured by turns, or fractional turns, of the screws 24) is detected and stored. Consequently, a small amount of dried paint located on the screw threads will result in an adjustment of the baseline reference current draw for that position. Once the baseline reference current draw has been established, a can or cans 42 may be placed in the machine 10 (step 52) and the clamping sequence started (step 54).

Step 50, in addition to obtaining a baseline reference, is useful in performing a basic cleaning function for the machine. As the clamping plate is driven through its entire range of motion, dried paint, dirt and grime, or other obstructive material present in the screw threads may be dislodged. Consequently, even in embodiments wherein the baseline reference is taken in another manner, it is preferred, from time to time, to drive the clamping plate through its entire range of motion as a "cleaning cycle." The machine may be advantageously programmed to perform the cleaning cycle after a specified period of idle time, such as 10 minutes.

Once the machine is started, it is advantageous at step 56 to ensure that various safety protocols have been met. For instance, for safety purposes, machines of this type are typically provided with a door, and one safety protocol may (and should) be that the door must be fully closed before clamping and shaking begin. Other safety protocols may include checking the line voltage and current availability of the electrical supply, a self-diagnostic of the microprocessor or its programming, and so on; these safety protocols are well known in the art and form no part of the present invention. If a safety protocol is not met, an error code is generated (step 57) and agitation is stopped (step 58).

Assuming the safety protocols are met, the plate 20 is incrementally driven downward by turning the screws 24 (step 60). Optionally, in order to save processor and detection time, at step 62 it is determined whether the clamping plate 20 is within an expected can height range, and if not, return to step 60. If it is, the current draw during the driven increment is detected (step 64), and the baseline reference value for that increment is subtracted from it (step 66). If the resulting current draw margin is about 0, then the sequence is returned to step 60. If, however, the margin is substantially greater than 0, then it is possible that a can has been detected, and the system proceeds to test whether a can has actually been detected at step 70.

At step 70, the clamping motor is optionally pulsed, preferably 3 times, in order to confirm that the clamping plate is seated on the can and to raise the clamping pressure to or near the appropriate clamping pressure for that can height. The position of the clamping plate 20 and the current draw are detected again. If the clamping plate 20 has moved significantly, then the detected current draw during pulsing will drop approximately to the baseline reference value, indicating that the initial reading was in fact anomalous (despite being in an expected range), and the sequence is returned to step 60. If the plate did not move significantly, the can height has been found (step 74) and pressure appropriate to the can type is added (step 76). Shaking may then begin (step 78).

The amount of clamping pressure to be added at step 76 can be determined by reference to the can height. For each typical size of paint can 42 (1-quart, 1-gallon, 5-gallon), there exists a range of permissible clamping pressures, from barely enough pressure to hold the can 42 to not quite enough pressure to crush the can 42. The amount of clamping pressure to be applied is advantageously between those values, which differ from size to size. By identifying beforehand the sizes of cans 42 that are likely to be shaken with the machine, it is possible to correlate the can height with the amount of pressure to be applied, and to apply a varying amount of pressure depending upon the height of the can 42.

Figure 4B:
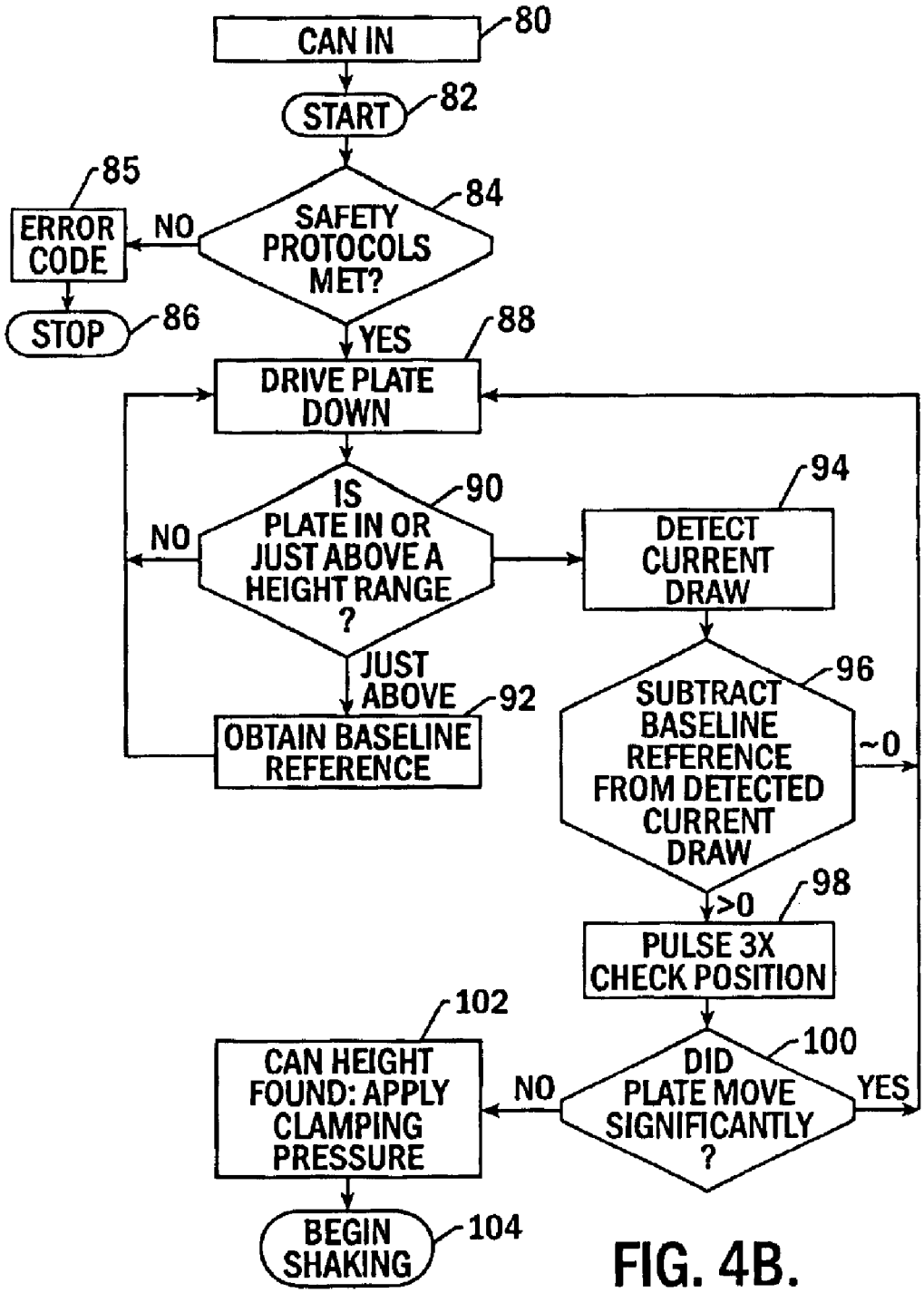
FIG. 4B is a flow chart illustrating the steps of an alternative embodiment of a method of clamping a paint can according to the present invention.

Paint cans 42 are typically presented in standard volumes, and while the cans may differ in height from maker to maker, the range of typical heights for cans of standard volumes is fairly consistent—typically within 1–2 inches of each other. Consequently, it may not be necessary to establish a baseline reference for the entire range of motion of the clamping plate. Referring now to FIG. 4B, in order to simplify the establishment of a baseline reference, in a second preferred embodiment of the present invention, the clamping sequence is started (steps 80, 82) without any baseline reference information. Instead, a range of possible can heights for the expected can sizes is established. After the safety protocols noted above (steps 56–58) have been satisfied at steps 84–86, the clamping plate 20 is driven down until it reaches a height some distance above the first range of expected can heights (iteratively through steps 88 and 90). Once the clamping plate is a given distance above the top of the expected range, the position of the clamping plate is detected, and a baseline reference current draw value for the incremental movement of the clamping plate 20 is obtained (step 92). In order to avoid localized anomalies, it is preferred to take as the baseline reference the average current draw, or the range of current draw values, for movement over a range just above the range of expected can heights. Once the clamping plate 20 has entered the first range of expected can heights, the current draw across each incremental movement is detected (step 94), and the baseline reference current draw is subtracted therefrom (step 96). If the resulting difference, which is the current draw margin, is approximately 0, then the sequence is returned to step 88. If, however, the resulting difference is substantially greater than 0, then the motor is pulsed at step 98 and checked for significant movement at step 100 (as noted in the first preferred embodiment at steps 70–72), and the can is clamped and shaken (steps 100–102).

Figure 5:
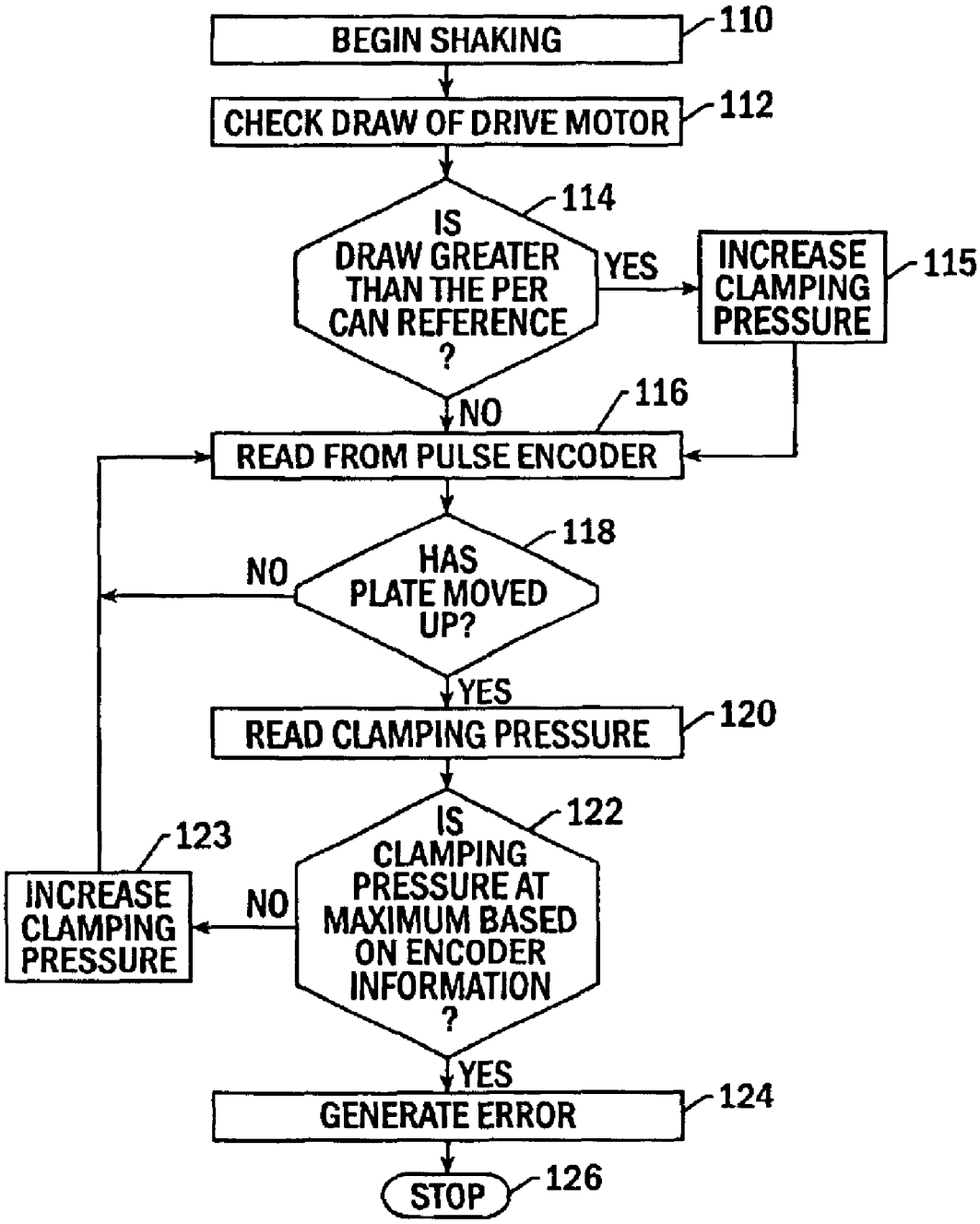
FIG. 5 is a flow chart illustrating the steps of gap correction according to the present invention.

In addition to being useful for purposes of determining the amount of clamping pressure to be applied initially to the can 42 before shaking, the information about the detected can height is useful in at least three other ways during the shaking process. Referring now to FIG. 5, once the can has undergone initial clamping (see FIGS. 4A–4B), the shaking process is begun (step 110). Prior to the beginning of the shaking process, the inner frame 14 (see FIG. 1) is drawn by gravity to the lowest point in its range of motion. As an optional step as the drive motor 18 is energized, the current draw required to carry the load placed on the support surface 22 to the top of the range of motion is detected (step 112). If the shaker 10 has been loaded with multiple cans 42, then the required current draw will be substantially higher than if the load were a single can 42. The amount of clamping pressure needed to hold the cans 42 securely may vary significantly depending upon the number of cans 42 loaded. Since the can height is known, an expected drive motor current draw for a single can 42 of that height may be established and compared to the current draw actually experienced (step 114). If the actual current draw is at a given level established for four cans, for instance, then additional clamping pressure may be applied at step 115.

This step may also permit an additional failsafe. If it can be determined that the machine is susceptible to breakage if loaded with more than a certain weight, a current draw correlating with a weight in excess of that weight, if detected, would indicate a damaging condition of the machine, and in such a case the microprocessor could stop the machine and generate an error code. This feature is particularly useful because paints, stains, and the like may have widely varying weights, and this feature prevents damage to the machine without requiring the operator to monitor the amount of weight placed in the machine.

A second use of the detected can height is in determining and setting an appropriate rate of agitation. As is well known in the art, a different magnitude of shaking—either in terms of the number of revolutions per minute, or the length of time for which shaking is conducted—is required depending upon the amount of paint to be shaken. Consequently, because the can height is known, the microprocessor 34B (see FIG. 2) may signal the drive motor control 19 to energize the drive motor 18 at a different number of revolutions per minute or for a different amount of time, depending upon the requirements of the amount of paint being shaken.

A third use for the information about can height is in detecting and correcting gaps between the can 42 and either the top clamping plate 20 or the support surface 22. Because of the rapid elliptical motion of the can 42 (as many as 700 revolutions per minute or more), and because of the presence of some measure of air in the can 42 (to prevent spillage, cans are typically not filled to their maximum capacity), the inertia of the paint within the can, the can itself, and the inner frame 14 may result in the development of a gap as noted above. Such a gap typically results because the clamping plate 20 "backs off" from its engagement with the top of the can 42.

One solution to this problem in conventional systems has been to leave the clamping motor 28 in an energized state at a reduced energy level, so as to compensate for any gaps that develop. However, this has not been an entirely satisfactory solution, in part because the amount of additional pressure is static and not responsive to sudden changes in the position of the clamping plate 28. In the present invention, the position of the clamping plate 28, having been previously detected, is monitored by the use of the encoder 36 (step 116). If the clamping plate 20 "backs off" its engagement with the can 42, the encoder 36 will detect the movement of the plate. This movement is detected at step 118, and at steps 120–122, the amount of pressure that had previously been applied is compared to the maximum amount of pressure that may be safely applied without crushing the can 42. If the maximum has not been reached, an additional amount of pressure, sufficient to return the clamping plate 20 to its original position, is generated by the clamping motor 28 at step 123. If the maximum has been reached (i.e., if any additional pressure would apparently result in crushing the can), an error code is generated at step 124 and the shaking process is stopped (step 126) for safety reasons.

Yet another feature of the present invention is likewise directed to correcting and preventing gaps between the clamping plates 20, 22 and the paint cans 42. Because the drive motor 18 is controlled by a drive motor control 19 under microprocessor control (34 or 34B), it is possible to "ramp up" the motion of the drive motor 18 by causing the drive motor 18 to reach its optimal speed over a period of time instead of instantaneously. Because the acceleration of the inner frame 14 is reduced, the impact of inertia on the effectiveness of clamping is further reduced.

This feature also enables the present invention to be used on an ordinary, non-dedicated 15-amp electrical circuit at 120VAC, rather than the dedicated circuit required by conventional systems of this type. Because the drive motor 18 must be fairly large, it has a significant inertia, which must be overcome in order to drive the inner frame 14. In order to overcome that inertia if the drive motor 18 is to be started at full speed, there exists a spike in the current draw of the drive motor 18 at starting, which may be sufficient to trip a circuit breaker if the machine is not on a dedicated line. Conventional machines thus typically require the full capacity of a dedicated 15-amp or 20-amp line at 120VAC. In the present invention, however, the drive motor 18 is not started at full speed, and the maximum current draw experienced at energization is well within the limits of a standard service (in preferred embodiments, on the order of 5 to 6 amperes). A retailer installing a device according to the present invention need not dedicate an entire circuit to the device and, depending on the capacity of the line, may place multiple devices, or other electrical devices, on the same circuit, such as would be impossible in conventional systems.

It should be noted, and those skilled in the art of mechanical agitation will recognize, that the present invention is susceptible of broad utility across a number of fields where mechanical agitation of a liquid-containing can is desirable or necessary. Although the apparatus and methods of the present invention were developed for use in the paint-mixing field—and within that field are included stains, varnishes, shellacs, and other such products not typically denominated as "paint," but which are intended to be within the usual field of the present invention—the present invention is potentially useful in agitating inks, foodservice items, and virtually any other liquid stored in a can, the mechanical agitation of which is desirable.

Additionally, the sizing, composition, and ratings of the various components of the embodiments of the present invention are advantageously determined with respect to the anticipated use of the embodiments of the present invention and themselves form no part of the present invention.

In view of the aforesaid written description of the present invention, it will be readily understood by those persons skilled in the art that the present invention is susceptible of broad utility and application. Many embodiments and adaptations of the present invention other than those herein described, as well as many variations, modifications, and equivalent arrangements, will be apparent from or reasonably suggested by the present invention and the foregoing description thereof, without departing from the substance or scope of the present invention. Accordingly, while the present invention has been described herein in detail in relation to preferred embodiments, it is to be understood that this disclosure is only illustrative and exemplary of the present invention and is made merely for purposes of providing a full and enabling disclosure of the invention. The foregoing disclosure is not intended nor is to be construed to limit the present invention or otherwise to exclude any such other embodiments, adaptations, variations, modifications and equivalent arrangements, the present invention being limited only by the claims appended hereto and the equivalents thereof.

What is claimed is:

1. A system for agitating a liquid-containing can, comprising:

an outer frame;

an inner frame mounted to the outer frame and mechanically isolated therefrom, the inner frame comprising a can support location, a clamping plate, and means for supporting the clamping plate for movement toward and away from the can support location;

a drive motor for driving the inner frame in order to agitate the can;

a microprocessor;

a clamping motor operable according to instructions of the microprocessor to drive the means for supporting the clamping plate to change the position of the clamping plate;

an encoder for detecting the position of the clamping plate relative to the can support location; and means for detecting a current draw of the clamping motor, the means for detecting configured to detect the current draw for a baseline reference state, representing a state of operation when the clamping motor is driving the means for supporting the clamping plate without engagement thereof with a can at the can support location, and a clamping state, representing a prevailing actual state of operation when the clamping motor is driving the means for supporting the clamping plate into engagement with a can present at the can support location;

the microprocessor being programmed to control movement of the clamping plate according to a subtractive comparison wherein the baseline reference state current draw is repetitively subtracted from the clamping state current draw and to stop and at least maintain the clamping plate in a can clamping position in response to a predetermined positive value of the subtractive comparison representing clamping engagement of the clamping plate with a can.

2. The system of claim 1, further comprising:

a drive motor control for controlling the operation of the drive motor according to a detected characteristic of the can.

3. The system of claim 2, wherein the detected characteristic is a height of the can.

4. A method of clamping at least one liquid-containing can in a mechanical can agitator comprising a clamping plate driveable using an electrical motor, the method comprising the steps of:

establishing a baseline reference current draw for the electrical motor when driving the clamping plate through a reference distance;

detecting an actual current draw for the electrical motor when driving the clamping plate through a driven distance;

subtracting the baseline reference current draw from the actual current draw to produce a current draw margin; and detecting a can height for the at least one can based upon the value of the current draw margin.

5. The method of claim 4, wherein the step of establishing a baseline reference current draw further comprises the step of:

establishing a baseline reference current draw over each a plurality of reference distances with the mechanical can agitator in an unladen state.

6. The method of claim 4, wherein the position of the clamping plate and the can height are detected using an encoder.

7. The method of claim 6, further comprising the step of:

associating a baseline reference current draw with a position of the clamping plate as measured using the encoder.

8. The method of claim 4, further comprising the step of:

verifying the presence of the can by pulsing the electrical motor.

9. The method of claim 8, further comprising the step of:

applying a clamping pressure to the at least one can according to the detected can height.

10. The method of claim 4, wherein the reference distance is the driven distance.

11. The method of claim 4, wherein the reference distance is located above the driven distance.

12. The method of claim 4, further comprising the steps of:

selecting at least one expected can height range; and driving the clamping plate to a first location above the at least one expected can height range.

13. The method of claim 12, wherein the reference distance is selected to be the distance from the first location to the top of the at least one expected can height range, and the driven distance is selected to be within the at least one expected can height range.

14. The method of claim 4, further comprising the step of:

cleaning the agitator by driving the clamping plate through its entire range of motion.

15. A method of retaining a clamped liquid-containing can in a mechanical can agitator during agitation, wherein the mechanical can agitator comprises an inner frame driven by a drive motor to agitate the can, a clamping plate, means for supporting and driving the clamping plate, an encoder for detecting the height of the clamping plate, and a clamping motor operable to drive means for supporting and driving the clamping plate to exert an initial clamping pressure on the can, the method comprising the steps of:

driving the clamping plate to exert and initial clamping pressure on the can;

detecting a reference position of the clamping plate at which the initial clamping pressure is exerted on the can;

driving the inner frame member to agitate the can while clamped by the initial clamping pressure;

monitoring the encoder for detecting a deviation of the clamping plate from the reference position indicating a loss of clamping pressure on the can; and upon the detecting of the deviation of the clamping plate, increasing the clamping pressure on the can to a level incrementally higher than the initial clamping pressure.

16. The method of claim 15, wherein the step of increasing the clamping pressure further comprises the steps of:

determining a maximum acceptable clamping pressure for the can; and discontinuing the agitation if the apparent increased clamping pressure would exceed the maximum acceptable clamping pressure.

17. The method of claim 15, wherein the initial clamping pressure is selected based upon a detected can height.

18. The method of claim 15, further comprising the step of:

bringing the drive motor gradually from a state of rest to a desired rate of agitation over a period of time selected to reduce a current draw spike.

19. The method of claim 15, further comprising the steps of:

detecting the weight and number of cans loaded in the agitator; and adjusting the initial clamping pressure or discontinuing agitation according to the weight and number of cans loaded.

* * * * *